US011348528B2

(12) United States Patent
Liu

(10) Patent No.: US 11,348,528 B2
(45) Date of Patent: May 31, 2022

(54) DISPLAY PANEL FOR OUTPUTTING DIFFERENT SETTING VOLTAGE BASED ON EQUIVALENT RESISTANCE

(71) Applicant: TCL CHINA STAR OPTOELECTRONICS TECHNOLOGY CO., LTD., Shenzhen (CN)

(72) Inventor: Jinfeng Liu, Shenzhen (CN)

(73) Assignee: TCL CHINA STAR OPTOELECTRONICS TECHNOLOGY CO., LTD., Shenzhen (CN)

( * ) Notice: Subject to any disclaimer, the term of this patent is extended or adjusted under 35 U.S.C. 154(b) by 0 days.

(21) Appl. No.: 17/251,797

(22) PCT Filed: Oct. 12, 2020

(86) PCT No.: PCT/CN2020/120342

§ 371 (c)(1),
(2) Date: Dec. 12, 2020

(65) Prior Publication Data

US 2022/0068207 A1 Mar. 3, 2022

(30) Foreign Application Priority Data

Sep. 2, 2020 (CN) ..... 202010909559.1

(51) Int. Cl.
*G09G 3/3258* (2016.01)
*G09G 3/3275* (2016.01)
*G09G 3/3266* (2016.01)

(52) U.S. Cl.
CPC ..... *G09G 3/3258* (2013.01); *G09G 3/3266* (2013.01); *G09G 3/3275* (2013.01); *G09G 2330/021* (2013.01)

(58) Field of Classification Search
CPC ..... G09G 3/3258
USPC ..... 345/204
See application file for complete search history.

(56) References Cited

U.S. PATENT DOCUMENTS

| | | | | |
|---|---|---|---|---|
| 10,140,929 | B2 | 11/2018 | Kim | |
| 2015/0255017 | A1* | 9/2015 | Kim | G09G 3/3225 315/172 |
| 2020/0194537 | A1* | 6/2020 | Yang | G09G 3/3258 |
| 2021/0210016 | A1* | 7/2021 | Li | G09G 3/3266 |

FOREIGN PATENT DOCUMENTS

| | | | |
|---|---|---|---|
| CN | 101017258 | A | 8/2007 |
| CN | 101192374 | A | 6/2008 |
| CN | 104537985 | A | 4/2015 |
| CN | 104821152 | A | 8/2015 |
| CN | 107016965 | A | 8/2017 |
| CN | 110782835 | A | 2/2020 |

* cited by examiner

*Primary Examiner* — Long D Pham
(74) *Attorney, Agent, or Firm* — PV IP PC; Wei Te Chung; Ude Lu

(57) ABSTRACT

The present application discloses a display panel and an electronic device. The display panel includes a power access end configured to supply a first power voltage. A driving module is configured to input a second power voltage to a second end of a light-emitting element under a control of a data signal. An equivalent resistance of a driving module of a pixel adjacent to the power access end is greater than an equivalent resistance of a driving module of a pixel away from the power access end.

16 Claims, 6 Drawing Sheets

DISPLAY PANEL FOR OUTPUTTING DIFFERENT SETTING VOLTAGE BASED ON EQUIVALENT RESISTANCE

RELATED APPLICATIONS

This application is a National Phase of PCT Patent Application No. PCT/CN2020/120342 having international filing date of Oct. 12, 2020, which claims the benefit of priority of Chinese Patent Application No. 202010909559.1 filed on Sep. 2, 2020. The contents of the above applications are all incorporated by reference as if fully set forth herein in their entirety.

FIELD OF INVENTION

The present application is related to the field of display technology, and specifically, to a display panel and an electronic device.

BACKGROUND OF INVENTION

In current organic light-emitting diode display technology, a light-emitting element is normally connected to a first power line to receive a first power voltage Vdd. Because a width of the first power line is relatively narrow, an equivalent resistance on the first power line is relatively large, so that a voltage drop occurs when a current flowing through the light-emitting element flows through the first power line. As a result, during a display process, the first power voltages Vdd actually supplied to the light-emitting element at a far end and a near end are different. This causes brightness of the light-emitting element at the far end and the near end to be different, resulting in the near end being bright and the far end being dark, and uneven brightness, which reduces a display effect.

SUMMARY OF INVENTION

The present application provides a display panel and an electronic device to increase a brightness uniformity, thereby increasing a display effect.

The display panel provided by an embodiment of the present application includes:

a power access end configured to supply a first power voltage;

a plurality of columns of pixels, wherein each of the columns of pixels includes a plurality of pixels, and each of the pixels includes:

a pixel driving circuit, including:

an input module configured to input a scan signal and a data signal; and a driving module connected to the input module, receiving a second power voltage, and including an equivalent resistance, wherein the input module is configured to input the data signal to the driving module under a control of the scan signal; and a light-emitting element, wherein a first end of the light-emitting element is connected to the first power voltage, a second end of the light-emitting element is connected to the driving module, and the driving module is configured to input the second power voltage to the second end of the light-emitting element under a control of the data signal;

wherein an equivalent resistance of a driving module of a pixel adjacent to the power access end is greater than an equivalent resistance of a driving module of a pixel away from the power access end, and the equivalent resistance is connected in series with the light-emitting element.

The electronic device further provided by an embodiment of the present application includes the above display panel.

The display panel and the electronic device include the power access end configured to supply the first power voltage and the plurality of columns of pixels, wherein each of the columns of pixels includes a plurality of pixels. Each of the pixels includes: a pixel driving circuit, including: an input module configured to input a scan signal and a data signal; and a driving module connected to the input module, receiving a second power voltage, and including an equivalent resistance, wherein the input module is configured to input the data signal to the driving module under a control of the scan signal; and a light-emitting element, wherein a first end of the light-emitting element is connected to the first power voltage, a second end of the light-emitting element is connected to the driving module, and the driving module is configured to input the second power voltage to the second end of the light-emitting element under a control of the data signal. The equivalent resistance of the driving module of a pixel adjacent to the power access end is greater than an equivalent resistance of a driving module of a pixel away from the power access end. Because the equivalent resistance of the driving module of the pixel adjacent to the power access end is greater, a voltage drop from a near end to a far end tends to be equal, and the brightness tends to be uniform.

DESCRIPTION OF DRAWINGS

In order to describe technical solutions in the present application clearly, drawings to be used in the description of embodiments will be described briefly below. Obviously, drawings described below are only for some embodiments of the present application, and other drawings can be obtained by those skilled in the art based on these drawings without creative efforts.

DETAILED DESCRIPTION OF PREFERRED EMBODIMENTS

Figure 1:
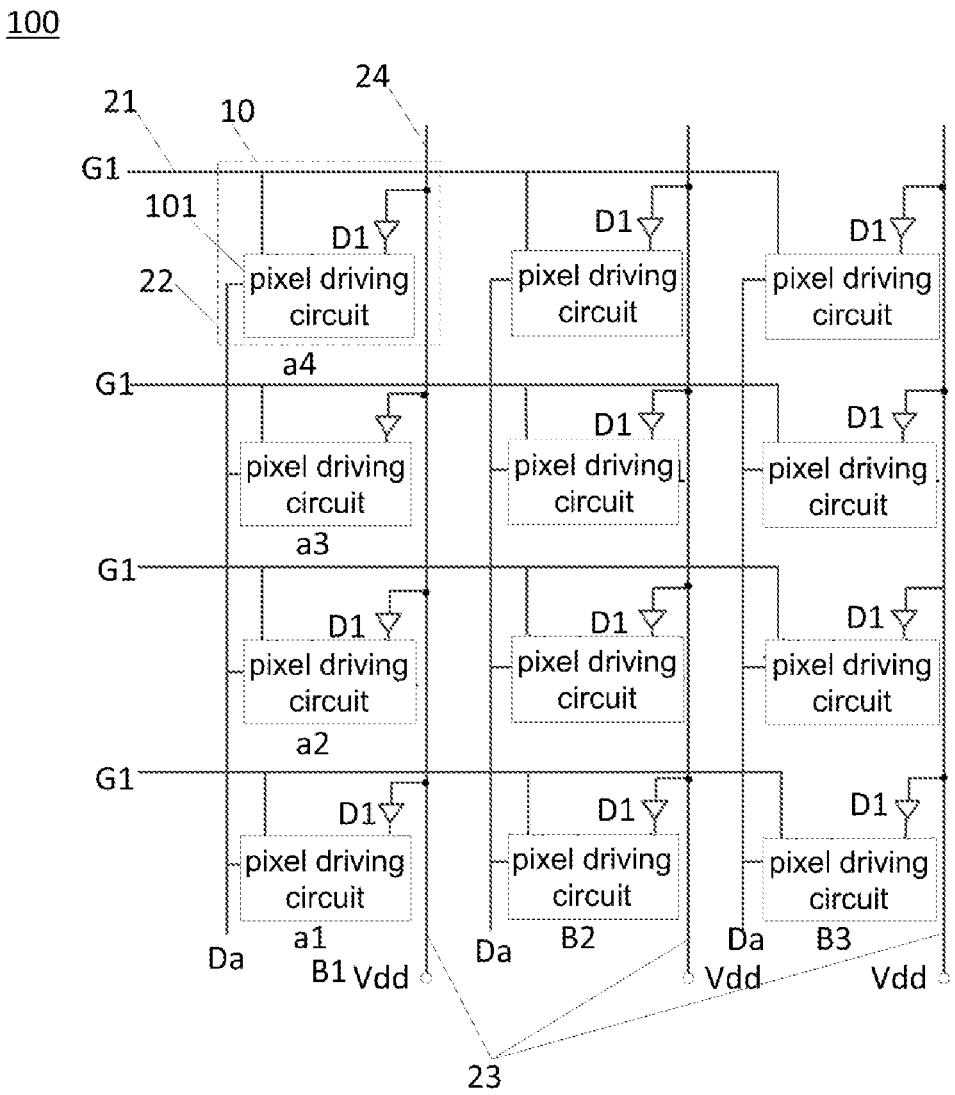
FIG. 1 is a structural schematic diagram of a display panel provided by an embodiment of the present application.

The technical solution of the present application embodiment will be clarified and completely described with reference accompanying drawings in embodiments of the present application embodiment. Obviously, the present application described parts of embodiments instead of all of the embodiments. Based on the embodiments of the present application, other embodiments which can be obtained by a skilled in the art without creative efforts fall into the protected scope of the of the present application.

In the description of the present application, it should be explained that the terms "center", "portrait", "transverse", "length", "width", "thickness", "upper", "lower", "front", the directions or positional relationships indicated by "back", "left", "right", "vertical", "horizontal", "top", "bottom", "inside", "outside", etc. are based on the drawings. The orientation or positional relationship is only for the convenience of describing the present application and simplifying the description, and does not indicate or imply that the device or element referred to must have a specific orientation, structure and operation in a specific orientation, and should not be viewed as limitations of the present application. In addition, terms "first" and "second" are used for descriptive purposes only, and cannot be understood as indicating or implying relative importance or implicitly indicating the number of technical features indicated. Therefore, the features defined as "first" and "second" may explicitly or implicitly include one or more of the features. In the description of the present application, the meaning of "multiple" is two or more, unless specifically defined otherwise.

In the description of the present application, it should be explained that terms "installation", "link", and "connection" should be understood broadly, unless explicitly stated and limited otherwise. For example, connection can be fixed connection or removable or integral connection, can be mechanical connection, electrical connection or mutual communication, can be direct connection or indirect connection through an intermedium, or can be the internal communication between two components or the mutual reaction between two components. For a skilled person in the art, the specific meanings of the above terms of the present application can be understood according to practical situations.

In the present application, unless explicitly stated and limited, the first feature is "on" or "under" the second feature may refer to that the first feature and second feature are directly contact, or are indirectly through another feature between them. Moreover, the first feature is "above", "upon", and "upper" the second feature, including that the first feature is directly above and obliquely above the second feature refers to that t the first feature is higher in level than the second feature. The first feature is "below", "down", and "under" of the second feature refers to that the first feature is directly below or obliquely below the second feature, or merely refers to that the first feature is horizontally lower than the second feature.

The following application provides many different embodiments or examples for implementing different structures of the present application. To simplify the application of the present application, the components and settings of specific examples are described below. Obviously, these are merely examples instead of limitation of the present application. Furthermore, the present application may repeat reference numbers and/or reference letters in different examples, and such repetition is for the purpose of simplicity and clarity, and does not indicate the relationship between the various embodiments and/or settings. Moreover, the present application provides examples of various specific processes and materials, but the applicability of other processes and/or application of other materials may be appreciated by a person skilled in the art.

Please refer to FIGS. 1 to 4. FIG. 1 is a structural schematic diagram of a display panel provided by an embodiment of the present application.

As shown in FIG. 1, in this embodiment, the display panel 100 includes a power access end 23 and a plurality of columns of pixels B1-B3. Each of the columns of pixels includes a plurality of pixels 10. Each of the pixels 10 includes a pixel driving circuit 101 and a light-emitting element D1. In addition, the display panel 100 can further include a plurality of scan lines 21, a plurality of data lines 22, and a plurality of power lines 24. A scan line 21 receives a scan signal G1. A data line 22 receives a data signal Da.

Figure 2:
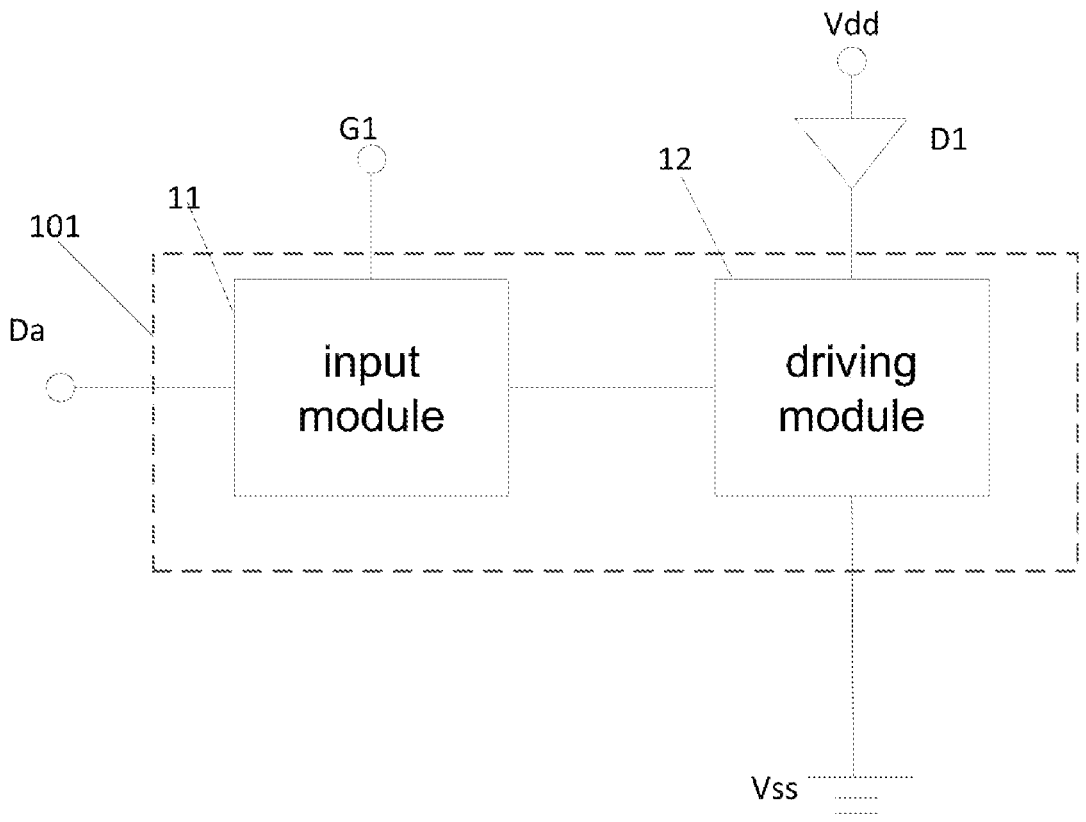
FIG. 2 is a structural schematic diagram of a pixel driving circuit provided by an embodiment of the present application.

With reference to FIG. 2, the pixel driving circuit 101 includes an input module 11 and a driving module 12.

The input module 11 is configured to input the scan signal G1 and the data signal Da. The input module 11 is configured to input the data signal Da to the driving module 12 under a control of the scan signal G1.

The driving module 12 is connected to the input module 11. The driving module 12 receives a second power voltage Vss. The driving module 12 is configured to input the second power voltage Vss to a second end of the light-emitting element D1 under a control of the data signal Da.

A first end of the light-emitting element D1 receives a first power voltage Vdd. The second end of the light-emitting element D1 is connected to the driving module 12. In an embodiment, the first end of the light-emitting element D1 is an anode, and the second end of the light-emitting element D1 is a cathode. The light-emitting element D1 includes, but is not limited to, an organic light-emitting diode or a micro light-emitting diode.

With reference to FIG. 1, an equivalent resistance of the driving module 12 of a pixel adjacent to the power access end 23 is greater than the equivalent resistance of the driving module 12 of a pixel away from the power access end 23, which means that the closer a distance to the power access end 23 is, the greater the equivalent resistance of the driving module 12 of the pixel is. The equivalent resistance is connected in series with the light-emitting element D1. In an embodiment, a first column of pixels is taken as an example, the pixels in the first column are respectively represented by a1-a4 for distinction, the equivalent resistance of the driving module of any one of the pixels a1, a2, and a3 is greater than the equivalent resistance of the driving module of the pixel a4. In another embodiment, from a side adjacent to the power access end 23 to a side away from the power access end 23, the equivalent resistance of the driving module 12 is gradually reduced. For example, the equivalent resistance of the driving module of the pixel a1 is greater than the equivalent resistance of the driving module of the pixel a2, the equivalent resistance of the driving module of the pixel a2 is greater than the equivalent resistance of the driving module of the pixel a3, and the equivalent resistance of the driving module of the pixel a3 is greater than the equivalent resistance of the driving module of the pixel a4. The remaining columns of pixels have a same principle.

Figure 3:
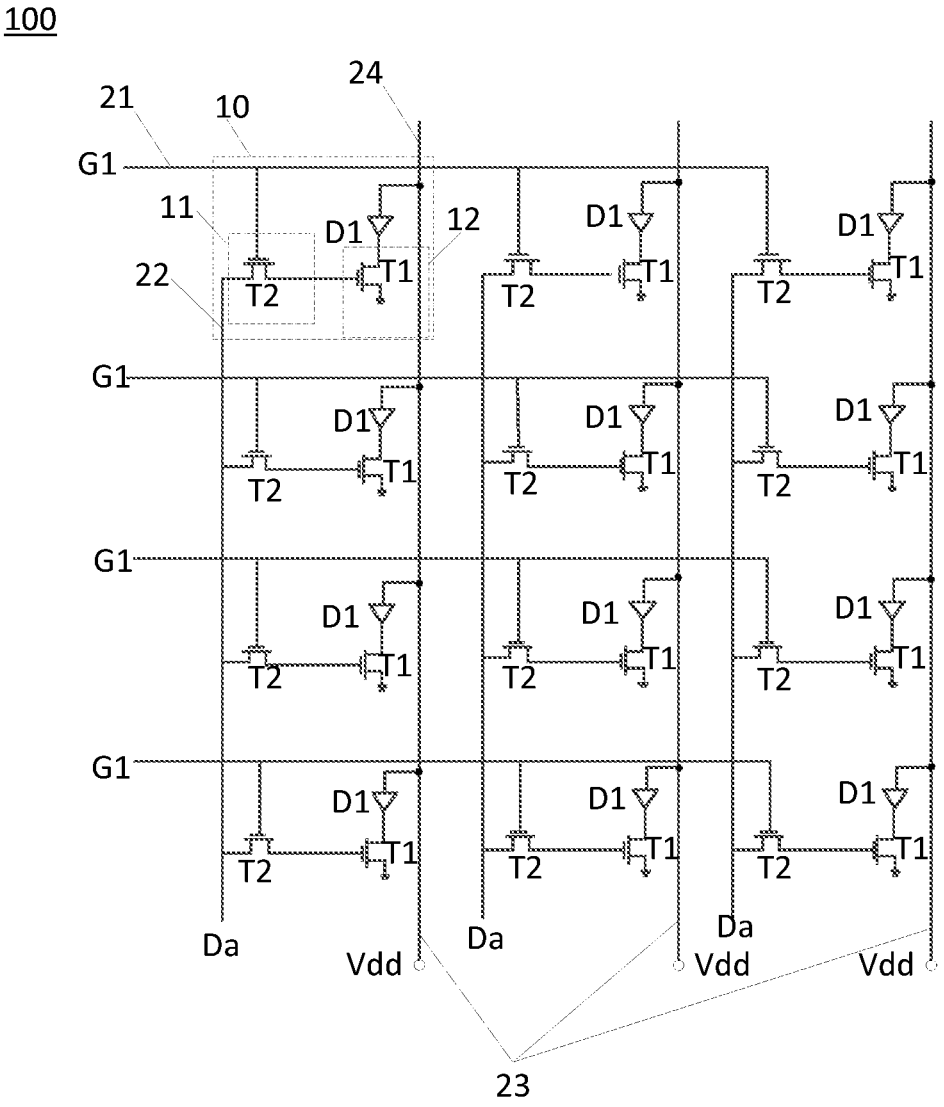
FIG. 3 is another structural schematic diagram of the display panel provided by an embodiment of the present application.
Figure 4:
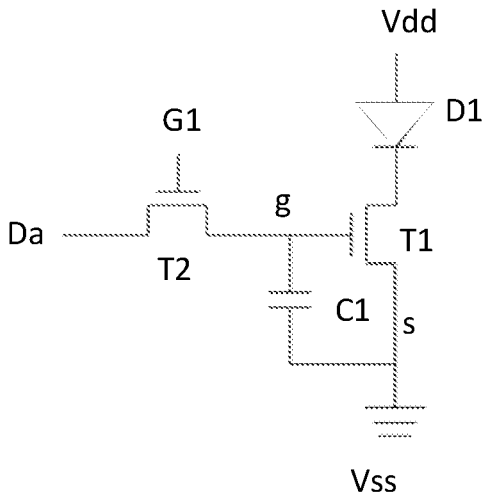
FIG. 4 is a structural schematic diagram of the pixel driving circuit in FIG. 3.
Figure 5:
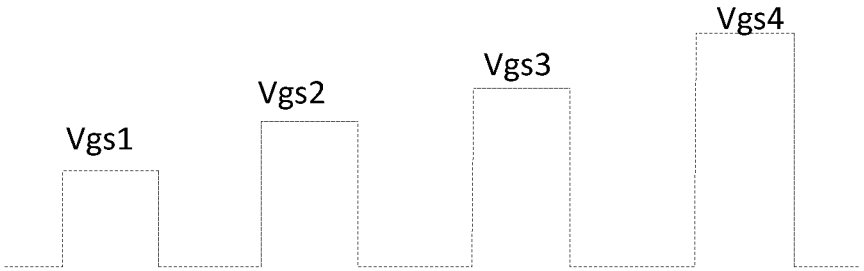
FIG. 5 is a waveform diagram of a gate/source voltage of a first switching element in each of pixels in one of columns of pixels provided by an embodiment of the present application.

In an embodiment, with reference to FIGS. 3 and 4, in order to further increase a brightness uniformity, the driving module 12 includes a first switching element T1, a setting voltage Vgs of the pixel adjacent to the power access end 23 is less than the setting voltage Vgs of the pixel away from the power access end 23. The setting voltage Vgs is a voltage from a gate g of the first switching element T1 to a source s of the first switching element T1. In a preferred embodiment, the setting voltage Vgs is gradually increased from the side adjacent to the power access end 23 to the side away from the power access end 23. As shown in FIG. 5, the first column of pixels is taken as an example, the setting voltage Vgs1 of the pixel a1 is less than the setting voltage Vgs2 of the pixel a2, the setting voltage Vgs2 of the pixel a2 is less than the setting voltage Vgs3 of the pixel a3, and the setting voltage Vgs3 of the pixel a3 is less than the setting voltage Vgs4 of the pixel a4. The remaining columns of pixels have a same principle. Of course, understandably, relationships between the setting voltages of the pixel are not limited to this.

Figure 6:
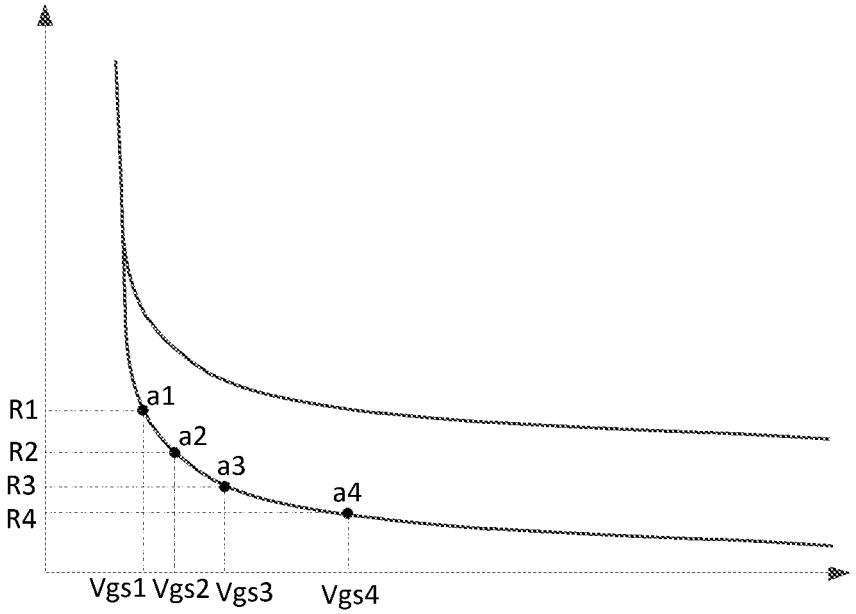
FIG. 6 is a diagram of a relationship between the gate/source of the first switching element and an equivalent resistance provided by an embodiment of the present application.

Please refer to FIG. 6, the abscissa represents the setting voltage Vgs of the first switching element, and the ordinate represents the equivalent resistance. The equivalent resistance can be a resistance between a source and a drain of the first switching element. The equivalent resistance corresponding to the setting voltage Vgs1 of the pixel a1 is R1, the equivalent resistance corresponding to the setting voltage Vgs2 of the pixel a2 is R2, the equivalent resistance corresponding to the setting voltage Vgs3 of the pixel a3 is R3, and the equivalent resistance corresponding to the setting voltage Vgs4 of the pixel a4 is R4. It can be seen that the less the setting voltage Vgs is, the greater the equivalent resistance is. Therefore, the brightness uniformity can be increased by reducing the setting voltage of the near end (adjacent to the power access end 23) and increasing the setting voltage of the far end (far away from the power access end 23), which means that R1>R2>R3>R4.

In an embodiment, in order to further increase the brightness uniformity, the input module 11 is configured to input the data signal Da to the first switching element T1 under the control of the scan signal G1.

A voltage of the data signal Da received by the input module 11 of the pixel adjacent to the power access end 23 is less than a voltage of the data signal Da received by the input module 11 of the pixel away from the power access end 23.

In an embodiment, with reference to FIGS. 3 and 4, the input module 11 includes a second switching element T2. A gate of the second switching element T2 receives the scan signal G1. A source of the second switching element T2 receives the data signal Da.

The gate of the first switching element T1 is connected to a drain of the second switching element T2. The source of the first switching element T1 receives the second power voltage Vss. The drain of the first switching element T1 is connected to the second end of the light-emitting element D1. In a preferred embodiment, the first switching element T1 can be a field-effect transistor, or of course, a thin-film transistor.

Figure 7:
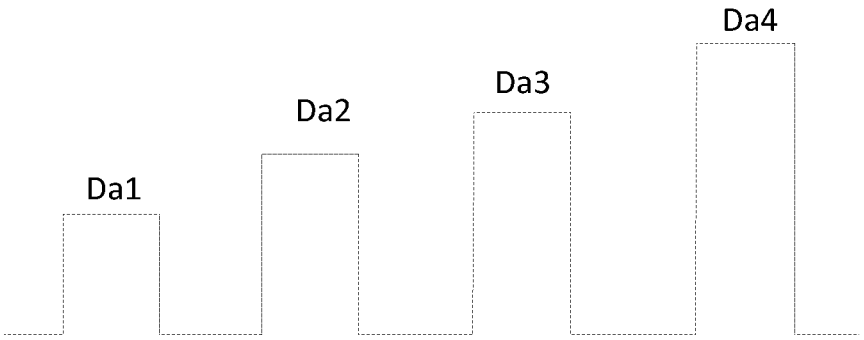
FIG. 7 is a waveform diagram of a data signal input by an input module in each of the pixels in one of the columns of pixels provided by an embodiment of the present application

A voltage of the data signal Da received by the second switching element T2 of the pixel adjacent to the power access end 23 is less than a voltage of the data signal Da received by the second switching element T2 of the pixel away from the power access end 23. With reference to FIGS. 1 and 7, in an embodiment, for example, the voltage of the data signal Da received by the second switching element T2 of any one of the pixels a1, a2, and a3 is less than the voltage of the data signal Da received by the second switching element T2 of the pixel a4. Meanwhile, the second power voltage received by each pixel is equal.

The pixel driving circuit 101 can further include a first capacitor C1, one end of the first capacitor C1 is connected to the gate of the first switching element T1, and the other end of the first capacitor C1 is connected to the source of the first switching element T1.

In an embodiment, with reference to FIG. 7, in order to further increase the brightness uniformity, from the side adjacent to the power access end 23 to the side away from the power access end 23, the voltage of the data signal Da received by the second switching element T2 of the pixels 10 is gradually reduced. Taking the first column of pixels as an example, the voltage Da1 of the data signal Da received by the second switching element T2 of the pixel a1 is less than the voltage Da2 of the data signal Da received the second switching element T2 of the pixel a2, the voltage Da2 of the data signal Da received by the second switching element T2 of the pixel a2 is less than the voltage Da3 of the data signal Da received the second switching element T2 of the pixel a3, the voltage Da3 of the data signal Da received by the second switching element T2 of the pixel a3 is less than the voltage Da4 of the data signal Da received the second switching element T2 of the pixel a4. The remaining columns of pixels have a same principle.

In an embodiment, with reference to FIG. 7, in order to further increase the brightness uniformity, differences between the voltages of the data signals Da received by the second switching elements T2 of two adjacent pixels in each of the columns of pixels are equal. A difference between the voltages Da2 and Da1 is equal to a difference between the voltages Da3 and Da2, and the difference between the voltages Da3 and Da2 is equal to a difference between the voltages Da4 and Da3.

Before compensation, when a value of the voltage Da is the same, the voltage drop (IR drop) of the four pixels a1, a2, a3, and a4 is gradually increased from the near end to the far end, so the near end is bright, and the far end is dark.

After compensation, the value of the voltage Da is gradually increased from the far end to the near end, so the setting voltage Vgs of each first switching element from the near end to the far end is different. As a result, a resistance between the source and the drain of the first switching element is gradually reduced, and a current from the near end to the far end tends to be equal. Therefore, the voltage from the near end to the far end tends to be equal by gradually reducing the equivalent resistance from the near end to the far end, and thus the brightness tends to be uniform. The voltage actually obtained on the light-emitting element is V1=Vdd−IR, wherein the voltage drop is equal to IR.

In another embodiment, with reference to FIGS. 3 and 4, the second power voltage Vss received by the driving module 12 of the pixel adjacent to the power access end 23 is greater than the second power voltage Vss received by the driving module 12 of the pixel away from the power access end 23.

In a preferred embodiment, the second power voltage Vss received by the source of the first switching element T1 of the pixel adjacent to the power access end 23 is greater than the second power voltage Vss received by the source of the first switching element T1 of the pixel away from the power access end 23. In an embodiment, for example, the second power voltage Vss received by the source of the first switching element T1 of any one of the pixels a1, a2, and a3 is greater than the second power voltage Vss received by the source of the first switching element T1 of the pixel a4. In another preferred embodiment, the second power voltage Vss received by the source of the first switching element T1 is gradually increased from the side adjacent to the power access end 23 to the side away from the power access end 23. In other words, the second power voltage received by the pixels from the near end to the far end is gradually reduced, meanwhile, the voltage of the data signal received by each pixel is equal, and Vgs=Vg−Vs.

Because the voltage Vg is equal to the voltage of the data signal, the setting voltage Vgs of the pixel adjacent to the power access end 23 is less than the setting voltage Vgs of the pixel away from the power access end 23 by gradually reducing the voltage Vs at the far end. As a result, the resistance between the source and the drain of the first switching element is gradually reduced, and the current from the near end to the far end tends to be equal. Therefore, the voltage from the near end to the far end tends to be equal by gradually reducing the equivalent resistance from the near end to the far end, and thus the brightness tends to be uniform.

Understandably, FIGS. 1 to 7 only give an example, which does not limit the present invention. The above display panel can also be configured as a backlight.

Figure 8:
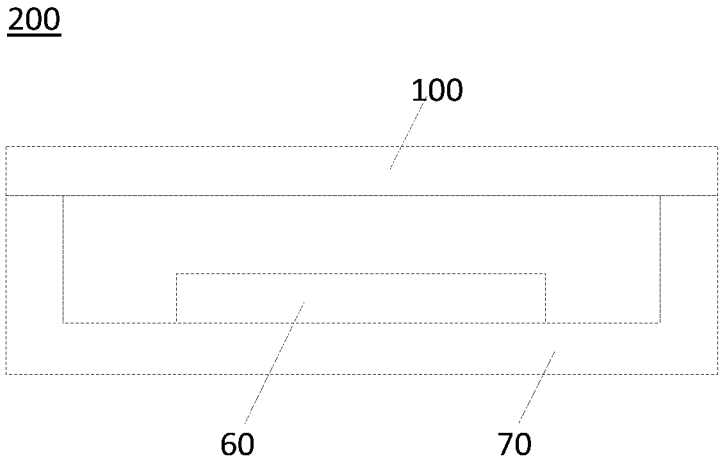
FIG. 8 is a structural schematic diagram of an electronic device provided by an embodiment of the present application.

Please refer to FIG. 8, FIG. 8 is a structural schematic diagram of an electronic device provided by an embodiment of the present application. The electronic device 200 can include the display panel 100, a control circuit 60, and a housing 70. It should be explained that the electronic device 200 shown in FIG. 8 is not limited to the above content, and it may also include other devices such as a camera, an antenna structure, and a fingerprint unlocking module.

The display panel 100 is disposed on the housing 70.

In an embodiment, the display panel 100 can be fixed to the housing 70. The display panel 100 and the housing 70 form a closed space to accommodate the control circuit 60 and other devices.

In an embodiment, the housing 70 can be made of a flexible material such as a plastic housing or a silicone housing.

The control circuit 60 is installed in the housing 70. The control circuit 60 can be a motherboard of the electronic device 200. The control circuit 60 can be integrated with one, two, or more of functional components such as a battery, an antenna structure, a microphone, a speaker, an earphone interface, a universal serial bus interface, a camera, a distance sensor, an ambient light sensor, a receiver, and a processor.

The display panel 100 is installed in the housing 70, meanwhile, the display panel 100 is electrically connected to the control circuit 60 to form a display surface of the electronic device 200. The display panel 100 can include a display region and a non-display region. The display region can be configured to display images of the electronic device 200 or for users to perform touch control. This non-display region can be configured to set various functional components.

The electronic device includes, but is not limited to, a mobile phone, a tablet computer, a computer display, a game console, a television, a display screen, a wearable device, and other lifestyle appliances or household appliances with display functions.

The display panel and the electronic device include the power access end configured to supply the first power voltage and the plurality of columns of pixels, wherein each of the columns of pixels includes the plurality of pixels. Each of the pixels includes: the pixel driving circuit, including: the input module configured to input the scan signal and the data signal; and the driving module connected to the input module, receiving the second power voltage, and including the equivalent resistance, wherein the input module is configured to input the data signal to the driving module under the control of the scan signal; the light-emitting element, wherein the first end of the light-emitting element is connected to the first power voltage, the second end of the light-emitting element is connected to the driving module, and the driving module is configured to input the second power voltage to the second end of the light-emitting element under the control of the data signal. The equivalent resistance of the driving module of the pixel adjacent to the power access end is greater than the equivalent resistance of the driving module of the pixel away from the power access end. Because the equivalent resistance of the driving module of the pixel adjacent to the power access end is greater, the voltage drop from the near end to the far end tends to be equal, and the brightness tends to be uniform.

The display panel and the electronic device provided by the present application is described in detail above, the specific examples of this document are used to explain principles and embodiments of the present application, and the description of embodiments above is only for helping to understand the present application. Meanwhile, those skilled in the art will be able to change the specific embodiments and the scope of the present application according to the idea of the present application. In the above, the content of the specification should not be construed as limiting the present application. Above all, the content of the specification should not be the limitation of the present application.

What is claimed is:

1. A display panel, comprising:

a power access end configured to supply a first power voltage; and a plurality of columns of pixels, wherein each of the columns of pixels comprises a plurality of pixels, and each of the pixels comprises:

a pixel driving circuit, comprising:

an input module configured to input a scan signal and a data signal, wherein the data signal is inputted to a first switching element under control of the scan signal; and a driving module connected to the input module, receiving a second power voltage, and comprising an equivalent resistance and the first switching element, wherein the input module is configured to input the data signal to the driving module under a control of the scan signal; and a light-emitting element, wherein a first end of the light-emitting element is connected to the first power voltage, a second end of the light-emitting element is connected to the driving module, and the driving module is configured to input the second power voltage to the second end of the light-emitting element under a control of the data signal; wherein an equivalent resistance of a driving module of a pixel adjacent to the power access end is greater than an equivalent resistance of a driving module of a pixel away from the power access end, and the equivalent resistance is connected in series with the light-emitting element;

wherein a setting voltage of the pixel adjacent to the power access end is less than a setting voltage of the pixel away from the power access end, and the setting voltage is a voltage from a gate of the first switching element to a source of the first switching element; and wherein a voltage of the data signal received by the input module of the pixel adjacent to the power access end is less than a voltage of the data signal received by the input module of the pixel away from the power access end.

2. The display panel according to claim 1, wherein the input module comprises a second switching element, a gate of the second switching element receives the scan signal, and a source of the second switching element receives the data signal;

the gate of the first switching element is connected to a drain of the second switching element, the source of the first switching element receives the second power voltage, and a drain of the first switching element is connected to the second end of the light-emitting element; and a voltage of the data signal received by the second switching element of the pixel adjacent to the power access end is less than a voltage of the data signal received by the second switching element of the pixel away from the power access end.

3. The display panel according to claim 2, wherein the voltage of the data signal received by the second switching element of the pixel is gradually increased from adjacent to the power access end to away from the power access end.

4. The display panel according to claim 3, wherein differences between the voltages of the data signals received by the second switching elements of two adjacent pixels in each of the columns of pixels are equal.

5. The display panel according to claim 1, wherein the equivalent resistance is a resistance between the source of the first switching element and a drain of the first switching element.

6. The display panel according to claim 1, wherein the second power voltage received by the driving module of the pixel adjacent to the power access end is greater than the second power voltage received by the driving module of the pixel away from the power access end.

7. The display panel according to claim 6, wherein the driving module comprises a first switching element, and the second power voltage received by a source of the first switching element of the pixel adjacent to the power access end is greater than the second power voltage received by a source of the first switching element of the pixel away from the power access end.

8. The display panel according to claim 7, wherein a voltage of the second power voltage received by the source of the first switching element is gradually decreased from adjacent to the power access end to away from the power access end.

9. An electronic device, comprising a display panel; wherein the display panel comprises:

a power access end configured to supply a first power voltage; and a plurality of columns of pixels, wherein each of the columns of pixels comprises a plurality of pixels, and each of the pixels comprises:

a pixel driving circuit, comprising:

an input module configured to input a scan signal and a data signal, wherein the data signal is inputted to a first switching element under control of the scan signal; and a driving module connected to the input module, receiving a second power voltage, and comprising an equivalent resistance and the first switching element, wherein the input module is configured to input the data signal to the driving module under a control of the scan signal; and a light-emitting element, wherein a first end of the light-emitting element is connected to the first power voltage, a second end of the light-emitting element is connected to the driving module, and the driving module is configured to input the second power voltage to the second end of the light-emitting element under a control of the data signal;

wherein an equivalent resistance of a driving module of a pixel adjacent to the power access end is greater than an equivalent resistance of a driving module of a pixel away from the power access end, and the equivalent resistance is connected in series with the light-emitting element;

wherein a setting voltage of the pixel adjacent to the power access end is less than a setting voltage of the pixel away from the power access end, and the setting voltage is a voltage from a gate of the first switching element to a source of the first switching element; and wherein a voltage of the data signal received by the input module of the pixel adjacent to the power access end is less than a voltage of the data signal received by the input module of the pixel away from the power access end.

10. The electronic device according to claim 9, wherein the input module comprises a second switching element, a gate of the second switching element receives the scan signal, and a source of the second switching element receives the data signal;

the gate of the first switching element is connected to a drain of the second switching element, the source of the first switching element receives the second power voltage, and a drain of the first switching element is connected to the second end of the light-emitting element; and a voltage of the data signal received by the second switching element of the pixel adjacent to the power access end is less than a voltage of the data signal received by the second switching element of the pixel away from the power access end.

11. The electronic device according to claim 10, wherein the voltage of the data signal received by the second switching element of the pixel is gradually increased from adjacent to the power access end to away from the power access end.

12. The electronic device according to claim 11, wherein differences between the voltages of the data signals received by the second switching elements of two adjacent pixels in each of the columns of pixels are equal.

13. The electronic device according to claim 9, wherein the equivalent resistance is a resistance between the source of the first switching element and a drain of the first switching element.

14. The electronic device according to claim 9, wherein the second power voltage received by the driving module of the pixel adjacent to the power access end is greater than the second power voltage received by the driving module of the pixel away from the power access end.

15. The electronic device according to claim 14, wherein the driving module comprises a first switching element, and the second power voltage received by a source of the first switching element of the pixel adjacent to the power access end is greater than the second power voltage received by a source of the first switching element of the pixel away from the power access end.

16. The electronic device according to claim 15, wherein a voltage of the second power voltage received by the source of the first switching element is gradually decreased from adjacent to the power access end to away from the power access end.

* * * * *